United States Patent [19]

Franko

[11] 3,981,085

[45] Sept. 21, 1976

[54] AIR STRIPPING DEVICE FOR ELASTOMERIC SURFACE

[75] Inventor: Eugene B. Franko, Marion, N.Y.

[73] Assignee: Xerox Corporation, Stamford, Conn.

[22] Filed: Feb. 10, 1975

[21] Appl. No.: 548,477

[52] U.S. Cl. ..... 355/3 R; 118/245; 271/DIG. 2; 432/60

[51] Int. Cl.[2] ..... G03G 15/20

[58] Field of Search ..... 271/DIG. 2, 80, 174; 355/3 FU, 3 R; 432/60, 228, 75; 118/60, 245

[56] References Cited

UNITED STATES PATENTS

| | | | |
|---|---|---|---|
| 3,706,491 | 12/1972 | Furman et al. | 355/3 FU |
| 3,804,401 | 4/1974 | Stange | 271/DIG. 2 |
| 3,837,640 | 9/1974 | Norton et al. | 271/DIG. 2 |
| 3,881,859 | 5/1975 | Hamilton | 271/DIG. 2 |
| 3,891,206 | 6/1975 | Bar-On | 271/DIG. 2 |

*Primary Examiner*—L. T. Hix
*Assistant Examiner*—Kenneth C. Hutchison

[57] ABSTRACT

An improved air stripping device for stripping copy sheets from the surface of an elastomeric fuser roll surface in which copies are fused under heat and pressure. The improved air stripping device utilizes the deformation in the elastomeric surface resulting from the pressure to strip the copy sheets without directly contacting the fuser roll surface. One or more apertures are formed in the tip portion of the stripping device which are connected to a source of air pressure. The tip portion can be either flat or curved and is positioned at an acute angle relative to tangential direction from which the copy sheet is stripped from the fuser roll surface which undergoes a rippled effect from the air pressure to facilitate the stripping of the copy sheets therefrom.

5 Claims, 4 Drawing Figures

AIR STRIPPING DEVICE FOR ELASTOMERIC SURFACE

This invention relates to an improved fusing apparatus for use with an electrostatic reproduction system and in particular to improved stripper fingers for elastomeric fuser roll surfaces for stripping copy sheets from the fuser roll surface.

It has been recognized that one of the preferred ways for fusing a powder image to a substrate is to bring the powder into direct contact with a hot surface, such as a heated roller. The roller surface may be dry, i.e. no application of liquid release agent to the surface of that roller as described for example, in U.S. Pat. Nos. 3,498,596 3,539,161, and 3,666,247. Alternatively, the fuser roll surface may be wetted with a release agent, such as silicone oil as described in U.S. Pat. Nos. 3,268,351 and 3,256,002.

A problem resulting from increased pressure and sharpness of the stripper fingers as described for example, in U.S. Pat. No. 3,450,402, may result in damage to the surface of the fuser roll especially in the case of the dry surface. Moreover, increased temperatures and pressure have caused deterioration to the fuser roll more rapidly resulting in greater costs and machine downtime. The present invention is an improved construction for the stripper finger which does not contact the fuser roll to eliminate the damage to the fuser roll surface and wear.

It is therefore the principle object of the present invention to improve heated pressure fusing roll devices.

It is a further object of the present invention to reduce significantly the wear on the fuser roll surfaces.

It is a further object of the present invention to eliminate damage to elastomeric fuser roll surfaces during stripping.

These and other objects of the invention and further features thereof will be better understood upon reference to the following detailed description of the invention to be read in connection with the accompanying drawings wherein.

Figure 2:
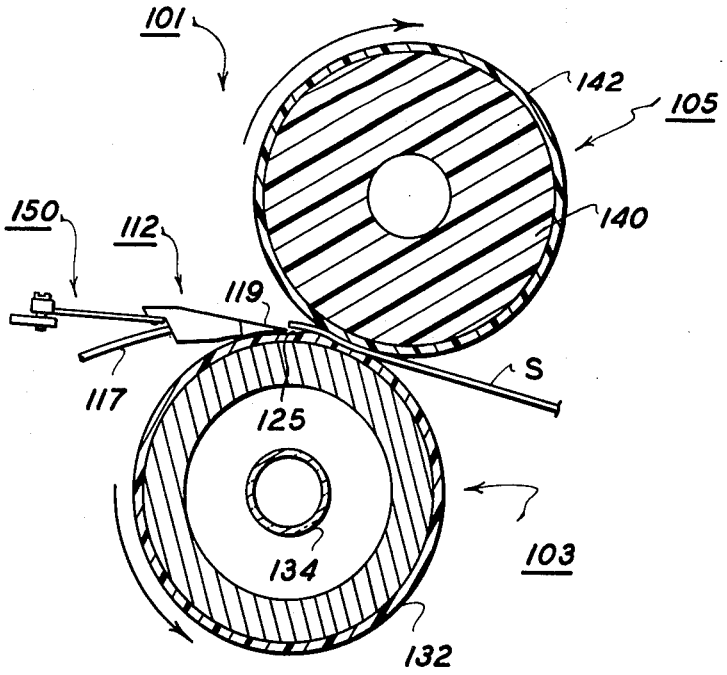
FIG. 2 is an enlarged cross sectional view of the fuser apparatus and stripping device under conditions with the copy sheet exiting the nip.
Figure 2A:
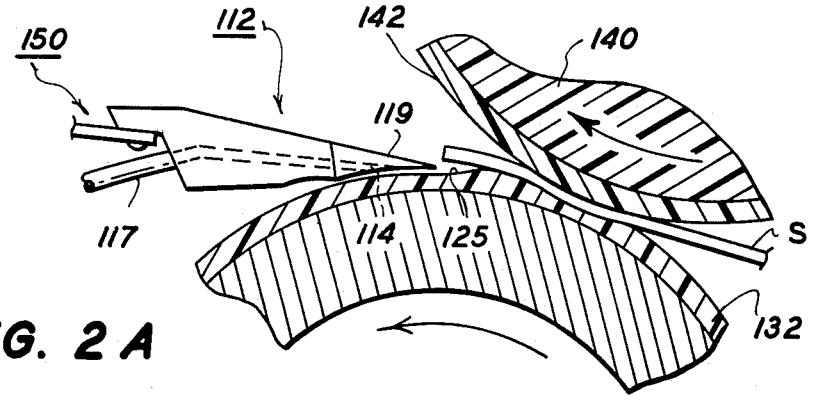
Figure 3:
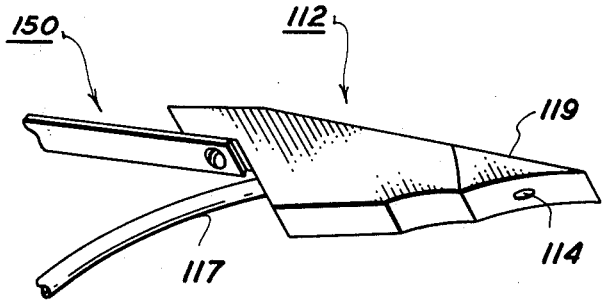

FIG. 2*a* is a greatly enlarged view of a portion of FIG. 2 illustrating details of the invention; and FIG. 3 is an isometric view of the improved stripper device.

Figure 1:
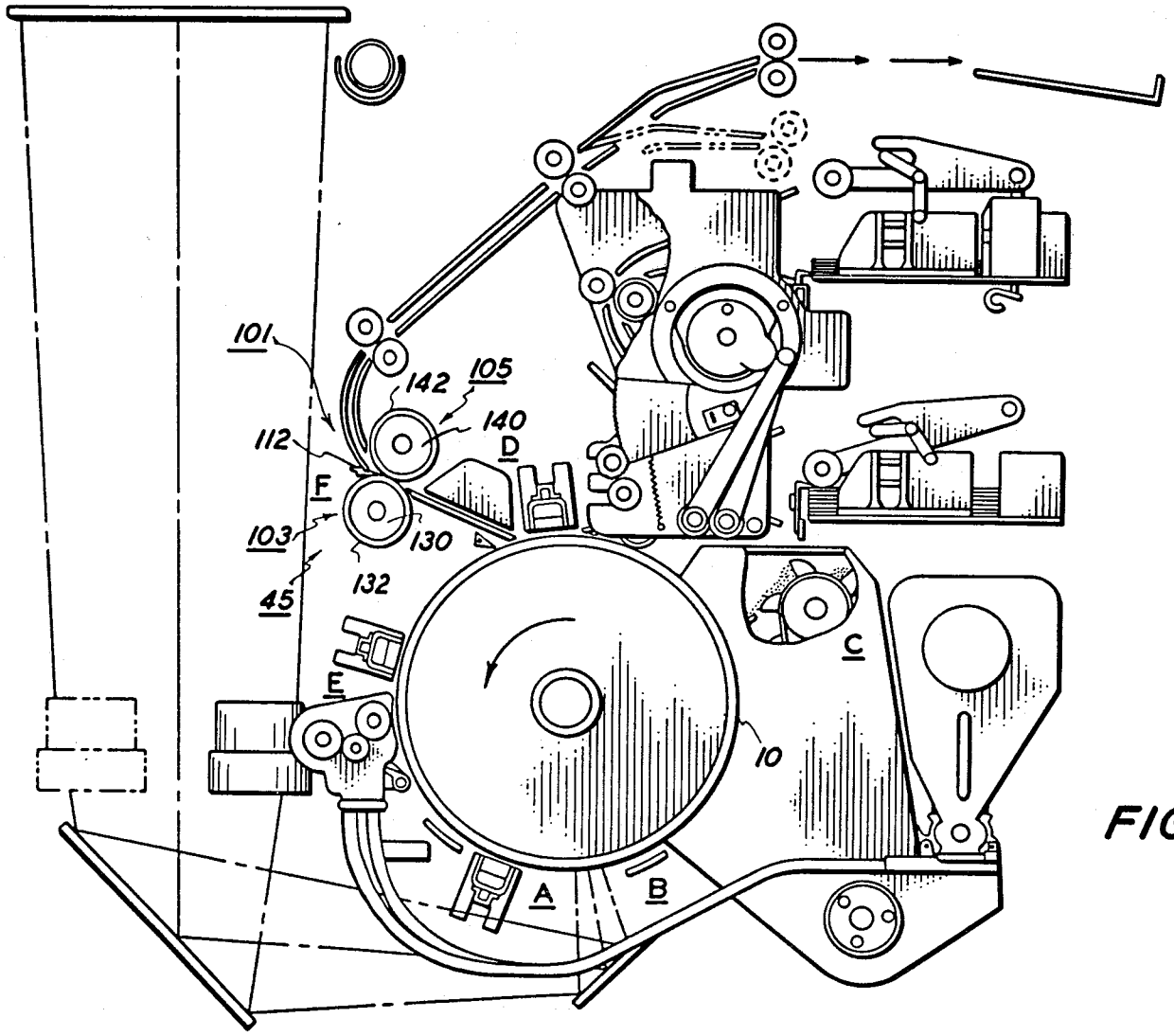
FIG. 1 illustrates schematically a xerographic reproducing apparatus incorporating a heated pressure fuser roll apparatus having an improved stripping device constructed in accordace with the present invention.

Referring now to the drawings, there is shown in FIG. 1 an embodiment of the subject invention in a suitable environment such as an automatic xerographic reproducing machine. The automatic xerographic reproducing machine includes a xerographic plate or surface formed in the shape of a drum. The plate has a photoconductive layer or light recieving surface on a conductive backing, journaled in a frame to rotate in the direction indicated by the arrow. The rotation will cause the plate surface to sequentially pass a series of xerographic processing stations. For the purpose of the present disclosure the several xerographic processing stations in the path of movement of the plate surface may be described functionally as follows:

A charging station A at which a uniform electrostatic charge is deposited on the photoconductive plate:

An exposure station B, at which light or a radiation pattern of copies to be reproduced is projected onto the plate surface to dissipate the charge in the exposed areas thereof to thereby form a latent electrostatic image of the copy to be reproduced;

A developing station C, at which xerographic developing material, including toner particles having an electrostatic charge opposite that of the latent electrostatic image, is cascaded over the latent electrostatic image to form a toner powder image configuration of the copy being reproduced;

A transfer station D at which the toner powder image is electrostatically transferred from the plate surface to a transfer material or a support surface; and A drum cleaning and discharge station E at which the plate surface is brushed to remove residual toner particles remaining thereon after image transfer and at which the plate is exposed to a relatively bright light source to effect substantially complete discharge of any residual electrostatic charge remaining thereon.

Further details of the aforementioned xerographic stations reference is made to U.S. Pat. No. 3,578,859, filed July 3, 1969 and commonly assigend herewith.

In accordance with the invention at the fusing station F is a fusing assembly 101 comprising a fuser roll 103 and pressure roll 105 through which the copy sheet to be fused is advanced through the nip formed by contact of the fuser roll and pressure. The copy sheet is stripped from the fuser roll 103 by one or more stripper members 112. The fuser roll comprises a rotating member 130 which can be made out of copper or aluminum and having an elastomeric compressible coating 132 made of silicone rubber or any suitable heat resistant compressible material as described, for example, in the aforementioned patents. The rotating member may be internally heated by a heat source 134 as described for example, in U.S. Pat. No. 3,666,247 or externally heated as described in U.S. Pat. Nos. 3,498,596 and 3,539,161. The pressure roll comprises a rotating member 140 which is covered with an elastomeric layer 142 preferably of a slightly higher durometer than the fuser roll coating 132 as described in the aforementioned patents.

Referring now to FIGS. 2, 2*a* and 3, the air stripping device or the invention comprises one or more stripper members 112 which serve to introduce pressurized air towards the surface of the fuser roll 132. In accordance with the invention one or more tiny apertures 114 are formed in the tip portion of the stripper member to direct pressurized air towards the fuser roll surface through the tip portion 119 of the stripper member. The stripper member is connected to a conduit 117 which in turn is connected to a source of pressurized air (not shown). By this arrangement pressurized air is supplied to apertures 114 formed in the surface of the stripper member which causes a deformation of the elastomeric surface of the fuser roll.

It will be appreciated that due to the elastomeric compressible, material of the fuser roll surface that a dimple or rippled effect 125 (FIG. 2*a*) is created thereby enabling the lead edge of the copy sheet material in the vicinity of tip 119 to be separated from the fuser roll surface. It will be further appreciated that since the powder images have been fused to the copy sheet S there is no danger of a pressurized air adversely affecting the characteristics of the powder image or detracting from image quality. As the fuser roll continues to rotate the separated copy sheet continues separation on the surface of stripper member 112. It has been found that the tip angle of the tip portion of the stripper member should be kept relatively small to reduce copy curl but that it should not be too large so that there is a possibility of a break in the fuser roll surface. It has been found that tip angles relative to the tangential stripping direction range from about 10°to about 30°.

A spring assembly 150 serves to position the stripper member 112 in close proximity with the fuser roll surface. It will be appreciated that the stripper member does not contact the fuser roll surface during the stripping operation but is held therefrom at a distance which may be readily adjusted such as by adjusting spring assembly 150. It has been found that the air pressure ranges from about 6 to about 13 lbs. per square inch for distances ranging from about 5 to about 35 mils. The tip portion 119 of the stripper member is coated from a material which has a low surface energy such as Teflon (trademark), manufactured by duPont Corporation of Wilmington, Del.

It will be appreciated that the improved air stripping device of the invention enables reliable stripping of the copy sheet from the fuser roll surface without causing damage or otherwise adversely affecting the sensitive, silicone rubber coating of the fuser roll. It will be appreciated that the present invention is a significant advance in the copying field and is highly advantageous over other stripping devices used for stripping copy sheets from elastomeric fuser roll surfaces.

While there has been shown and described and pointed out the fundamental novel features of the invention as applied to a preferred embodiment, it will be understood that various omissions and substitutions and changes in the form and details of the device illustrated in its operation may be made by those skilled in the art without departing from the spirit of the invention.

What is claimed is:

1. In an electrostatic reproduction machine in which copies are produced from document information and wherein the powder images are fixed to the copy sheets by passing the powder images on the sheets through a nip formed by an elastomeric fuser roll and a back up roll which apply heat and pressure thereby fusing the powder images onto the sheets, an improved stripping apparatus for stripping copy sheets from the surface of an elastomeric fuser roll comprising:

a stripper member positioned at a predetermined distance from an elastomeric fuser roll surface and from which copy sheets are to be stripped, said stripper member having a tip portion having at least one aperture formed therein facing the elastomeric fuser roll surface at an acute angle relative to a tangent to the fuser roll surface, air supply means for providing pressurized air in communication with the aperture to cause a rippled effect on the elastomeric fuser roll surface to cause separation of the copy sheet leading edge therefrom onto the stripper member, wherein the tip portion of the stripper member is positioned at an angle ranging from about 10° to 30° relative to a tangent to the fuser roll surface.

2. Apparatus according to claim 1 including adjustable biasing means for varying the spacing of the stripper member from the fuser roll.

3. Apparatus according to claim 1 wherein the tip portion of the stripper member has a coating made our of a material which has a low surface-free energy.

4. Apparatus according to claim 1 wherein the elastomeric fuser roll surface is made of silicone rubber.

5. Apparatus according to claim 1 wherein the air pressure ranges from about 6 to 13 psi for distances ranging from about 5 to about 35 mils.

* * * * *